US008171990B2

(12) United States Patent
Tchakarov et al.

(10) Patent No.: US 8,171,990 B2
(45) **Date of Patent: *May 8, 2012**

(54) IN-SITU FORMATION STRENGTH TESTING WITH CORING

(75) Inventors: Borislav J. Tchakarov, Humble, TX (US); James C. Hunziker, New Caney, TX (US); Quan V. Phan, Houston, TX (US); Mohammed Azeemuddin, Sugar Land, TX (US); See H. Ong, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 133 days.

This patent is subject to a terminal disclaimer.

(21) Appl. No.: 12/323,187

(22) Filed: Nov. 25, 2008

(65) Prior Publication Data

US 2010/0051347 A1 Mar. 4, 2010

Related U.S. Application Data

(60) Provisional application No. 60/990,526, filed on Nov. 27, 2007.

(51) Int. Cl.
*E21B 49/00* (2006.01)

(52) U.S. Cl. ..... 166/250.01; 175/50; 73/152.59

(58) Field of Classification Search ..... 166/250.01, 166/66, 250.17; 175/50; 73/152.59
See application file for complete search history.

(56) References Cited

U.S. PATENT DOCUMENTS 3,243,695 A * 3/1966 Roark et al. ..... 324/376
3,992,928 A * 11/1976 Thoms ..... 73/784
4,461,171 A 7/1984 de la Cruz
4,510,799 A * 4/1985 Overmier ..... 73/152.59
4,537,063 A 8/1985 Barnaby
4,692,707 A 9/1987 Locke et al.
4,957,162 A * 9/1990 Etourmy et al. ..... 166/212
5,165,274 A 11/1992 Thiercelin ..... 73/151
5,323,648 A 6/1994 Peltier et al. ..... 73/151
5,487,433 A 1/1996 MacKay et al.
5,517,854 A 5/1996 Plumb et al. ..... 73/151
6,164,126 A 12/2000 Ciglenec et al.
6,234,257 B1 5/2001 Ciglenec et al.
6,581,455 B1 6/2003 Berger et al.
7,152,466 B2 12/2006 Ramakrishnan et al.
2004/0237640 A1 12/2004 Meister et al.
2005/0194134 A1 9/2005 McGregor et al.
2006/0000603 A1 * 1/2006 Zazovsky et al. ..... 166/244.1
2007/0137894 A1 6/2007 Fujisawa et al.
2009/0133486 A1 5/2009 Tchakarov et al. ..... 73/152.02
2009/0164128 A1 6/2009 Tchakarov et al. ..... 702/11

OTHER PUBLICATIONS

International Search Report dated Feb. 4, 2009.

International Search Report and Written Opinion, dated Jun. 11, 2009, 8 pages.

International Search Report and the Written Opinion of the International Searching Authority, or the Declaration, Baker Hughes Incorporated, PCT/US2008/084873.

* cited by examiner

*Primary Examiner* — David Andrews
(74) *Attorney, Agent, or Firm* — Shawn Hunter

(57) ABSTRACT

A method and apparatus for estimating one or more formation properties using in-situ measurements conducted at or near a coring location include a coring tool adapted to cut a core sample in a formation, a member having a distal end that engages a borehole wall substantially adjacent the core sample, and a drive device that engages the member to the borehole wall with a force sufficient to estimate formation strength.

20 Claims, 11 Drawing Sheets

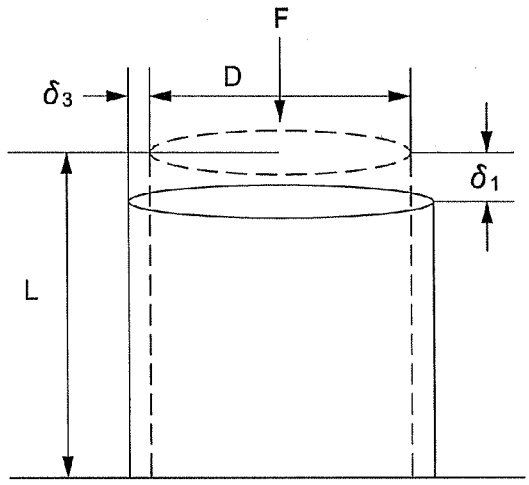

$\sigma_1$ = F / area
$\varepsilon_1 = \delta_1 / L$
$\varepsilon_3 = 2^*\delta_3 / D$
$E = \delta\sigma_1 / \delta\varepsilon_1$
$\nu = -\delta\varepsilon_3 / \delta\varepsilon_1$
UCS = $\sigma_{max}$

FIG. 10

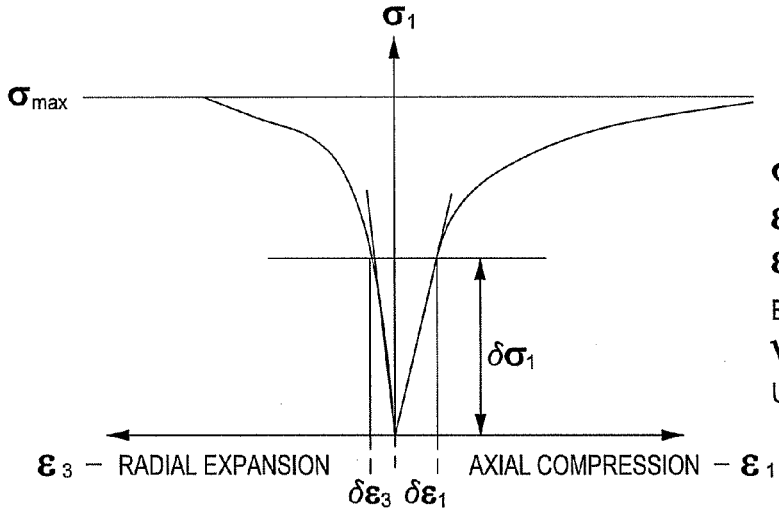

$\sigma_1$ = F / area
$\varepsilon_1 = \delta_1 / L$
$\varepsilon_3 = 2^*\delta_3 / D$
$E = \delta\sigma_1 / \delta\varepsilon_1$
$\nu = -\delta\varepsilon_3 / \delta\varepsilon_1$
UCS = $\sigma_{max}$

FIG. 11

IN-SITU FORMATION STRENGTH TESTING WITH CORING

CROSS-REFERENCE TO RELATED APPLICATIONS

The present application is a non-provisional application of U.S. provisional application 60/990,526 filed on Nov. 27, 2007, the entire specification being hereby incorporated herein by reference.

BACKGROUND

1. Technical Field

The present disclosure generally relates to well bore tools and in particular to methods and apparatus for estimating in-situ formation properties.

2. Background Information

Oil and gas wells have been drilled at depths ranging from a few thousand feet to as deep as five miles. A large portion of the current drilling activity involves directional drilling that includes drilling boreholes deviated from vertical by a few degrees to horizontal boreholes, to increase the hydrocarbon production from earth formations.

Information about the subterranean formations traversed by the borehole may be obtained by any number of techniques. Techniques used to obtain formation information include obtaining one or more core samples of the subterranean formations and obtaining fluid samples produced from the subterranean formations these samplings are collectively referred to herein as formation sampling. Core samples are often retrieved from the borehole and tested in a rig-site or remote laboratory to determine properties of the core sample, which properties are used to estimate formation properties. Modern fluid sampling includes various downhole tests and sometimes fluid samples are retrieved for surface laboratory testing.

Laboratory tests suffer in that in-situ conditions must be recreated using laboratory test fixtures in order to obtain meaningful test results. These recreated conditions may not accurately reflect actual in-situ conditions and the core and fluid samples may have undergone irreversible changes in transit from the downhole location to the surface laboratory. Furthermore, downhole fluid tests do not provide information relating to formation direction and other rock properties.

SUMMARY

The following presents a general summary of several aspects of the disclosure in order to provide a basic understanding of at least some aspects of the disclosure. This summary is not an extensive overview of the disclosure. It is not intended to identify key or critical elements of the disclosure or to delineate the scope of the claims. The following summary merely presents some concepts of the disclosure in a general form as a prelude to the more detailed description that follows.

Disclosed is an apparatus for estimating a formation property. The apparatus includes a coring tool adapted to cut a core sample in a formation, a member having a distal end that engages a borehole wall substantially adjacent the core sample, and a drive device that engages the member to the borehole wall with a force sufficient to estimate formation strength.

Also disclosed is a method for estimating a property. The method includes cutting a core sample in a formation using a coring tool, and engaging a borehole wall substantially adjacent the core sample location with a member using drive device that engages the member to the borehole wall with a force sufficient to estimate formation strength.

Also disclosed is a method for estimating a formation property that includes cutting a core sample in a subterranean formation at the core sample location, the cut core sample remaining connected to the subterranean formation, and performing a formation strength test on the cut core sample in-situ.

BRIEF DESCRIPTION OF THE DRAWINGS

For a detailed understanding of the present disclosure, reference should be made to the following detailed description of the several non-limiting embodiments, taken in conjunction with the accompanying drawings, in which like elements have been given like numerals and wherein:

FIG. 10 graphically illustrates a formation core sample response to an applied force;

FIG. 11 is an exemplary stress vs. strain plot that shows core sample deformation in axial and radial directions due to an applied force.

DESCRIPTION OF EXEMPLARY EMBODIMENTS

Figure 1:
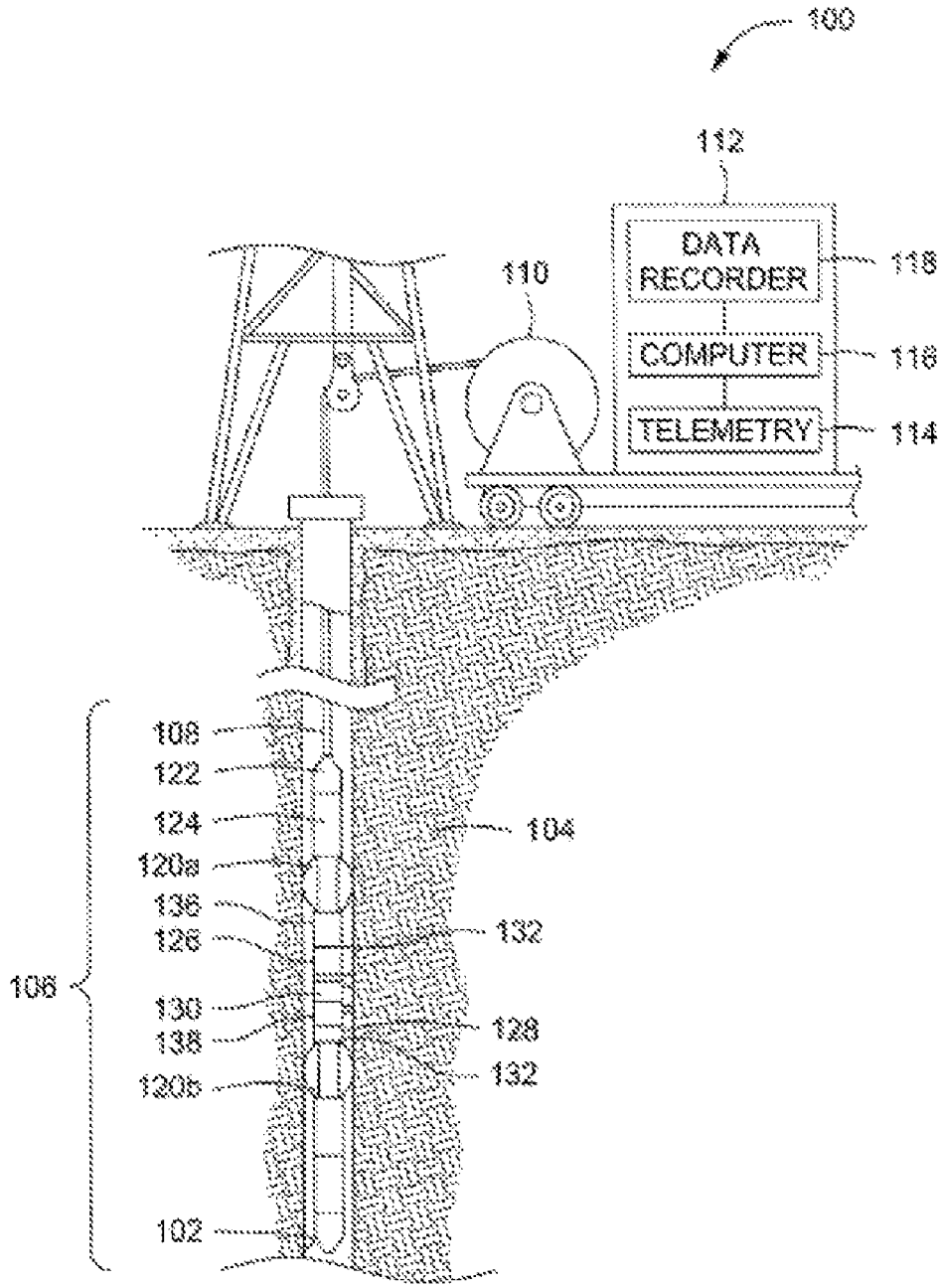
FIG. 1 illustrates a non-limiting example of a well logging apparatus according to several embodiments of the disclosure.

With reference to FIG. 1, a non-limiting example of a well logging apparatus 100 according to several embodiments of the disclosure will be described. The well logging apparatus 100 is shown disposed in a well borehole 102 penetrating earth formations 104 for making measurements of properties of the earth formations 104. The borehole 102 is typically filled with a fluid having a density sufficient to prevent formation fluid influx.

A string of logging tools, or simply, tool string 106 is shown lowered into the well borehole 102 by an armored electrical cable 108. The cable 108 can be spooled and unspooled from a winch or drum 110. The tool string 106 may be configured to convey information signals to surface equipment 112 by an electrical conductor and/or an optical fiber (not shown) forming part of the cable 108. The surface equipment 112 can include one part of a telemetry system 114 for communicating control signals and data signals to the tool string 106 and may further include a computer 116. The computer can also include a data recorder 118 for recording measurements made by the tool string 106 sensors and transmitted to the surface equipment 112.

The exemplary tool string 106 may be centered within the well borehole 102 by a top centralizer 120*a* and a bottom centralizer 120*b* attached to the tool string 106 at axially spaced apart locations. The centralizers 120*a*, 120*b* can be of types known in the art such as bowsprings or inflatable packers. In other non-limiting examples, the tool string 106 may be forced to a side of the borehole 102 using one or more extendable members.

The tool string 106 of FIG. 1 illustrates a non-limiting example of an in-situ formation strength test tool in combination with a rotary coring tool, along with several examples of supporting functions that may be included on the tool string 106. The tool string 106 in this example is a carrier for conveying several sections of the tool string 106 into the well borehole 102. The tool string 106 includes an electrical power section 122 and an electronics section 124 is coupled to the electrical power section 122. A mechanical power section 126 is disposed on the tool string 106 and is coupled in this example to the electronics section 124. A mandrel section 128 is shown disposed on the tool string 106 below the mechanical power section 126 and the mandrel section 128 includes a formation strength test device 130 and a rotary side-wall coring tool 138.

The electrical power section 122 receives or generates, depending on the particular tool configuration, electrical power for the tool string 106. In the case of a wireline configuration as shown in this example, the electrical power section 122 may include a power swivel that is connected to the wireline power cable 108. In the case of a while-drilling tool, the electrical power section 122 may include a power generating device such as a mud turbine generator, a battery module or other suitable downhole electrical power generating device. In some examples wireline tools may include power generating devices and while-drilling tools may utilize wired pipes for receiving electrical power and communication signals from the surface. The electrical power section 122 may be electrically coupled to any number of downhole tools and to any of the components in the tool string 106 requiring electrical power. The electrical power section 122 in the example shown provides electrical power to the electronics section 124.

Figure 2:
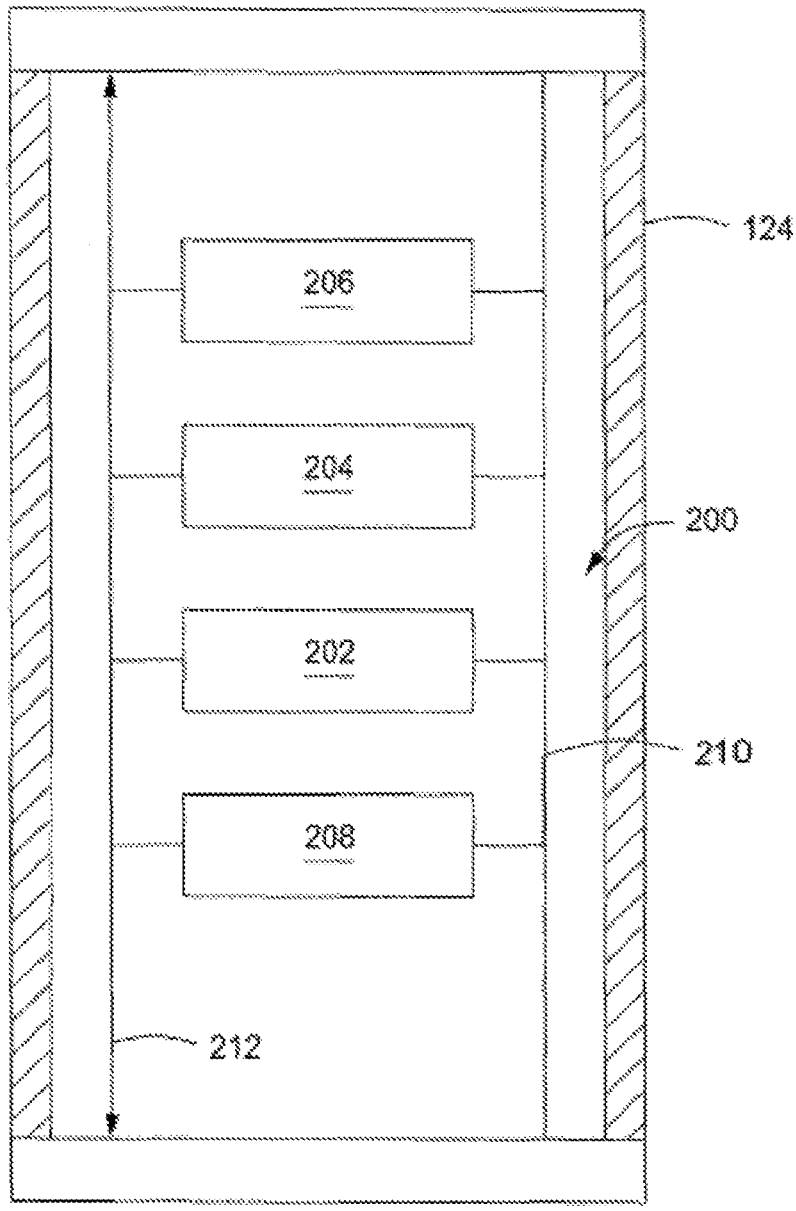
FIG. 2 is a non-limiting example of a downhole tool electronics section that may be used with a well logging apparatus.

With reference to FIGS. 1 and 2, the electronics section 124 may include any number of electrical components for facilitating downhole tests, information processing and/or storage. In some non-limiting examples, the electronics section 124 includes a processing system 200 that includes at least one information processor 202. The processing system 200 may be any suitable processor-based control system suitable for downhole applications and may utilize several processors depending on how many other processor-based applications are to be included in the tool string 106. Some electronic components may include added cooling, radiation hardening, vibration and impact protection, potting and other packaging details that do not require in-depth discussion here. Processor manufacturers that produce processors 202 suitable for downhole applications include Intel, Motorola, AMD, Toshiba and others.

In wireline applications, the electronics section 124 may be limited to transmitter and receiver circuits to convey information to a surface controller and to receive information from the surface controller via a wireline communication cable. In the example shown, the processor system 200 further includes a memory unit 204 for storing programs and information processed using the processor 202. Transmitter and receiver circuits 206 are included for transmitting and receiving information to and from the tool string 106. Signal conditioning circuits 208 and any other electrical component suitable for the tool string 106 may be housed within the electronics section 124. A power bus 210 may be used to communicate electrical power from the electrical power section 122 to the several components and circuits housed within the electronics section 124. A data bus 212 may be used to communicate information between the mandrel section 128 and the processing system 200 and between the processing system 200 and the surface computer 116 and recorder 118. The electrical power section 122 and electronics section 124 may be used to provide power and control information to the mechanical power section 126 where the mechanical power section 126 includes electro-mechanical devices.

In the non-limiting example of FIG. 1, the mechanical power section 126 may be configured to include any number of power generating devices 136 to provide mechanical power to the formation strength test device 130. The power generating device or devices 136 may include one or more of a hydraulic unit, a mechanical power unit, an electro-mechanical power unit or any other unit suitable for generating mechanical power for the mandrel section 128 and other not-shown devices requiring mechanical power.

In several non-limiting examples, the mandrel section 128 may utilize mechanical power from the mechanical power section 126 and may also receive electrical power from the electrical power section 126. Control of the mandrel section 128 and of devices on the mandrel section 128 may be provided by the electronics section 124 or by a controller disposed on the mandrel section 128. In some embodiments, the power and control may be used for orienting the mandrel section 128 within the well borehole. The mandrel section 128 can be configured as a rotating sub that rotates about and with respect to the longitudinal axis of the tool string 106. Bearing couplings 132 and drive mechanism 134 may be used to rotate the mandrel section 128. In other examples, the mandrel section 128 may be oriented by rotating the tool string 106 and mandrel section 128 together. The electrical power from the electrical power section 122, control electronics in the electronics section 124, and mechanical power from the mechanical power section 126 may be in communication with the mandrel section 128 to power and control the formation strength test device 130 and with the coring tool 138.

Figure 3:
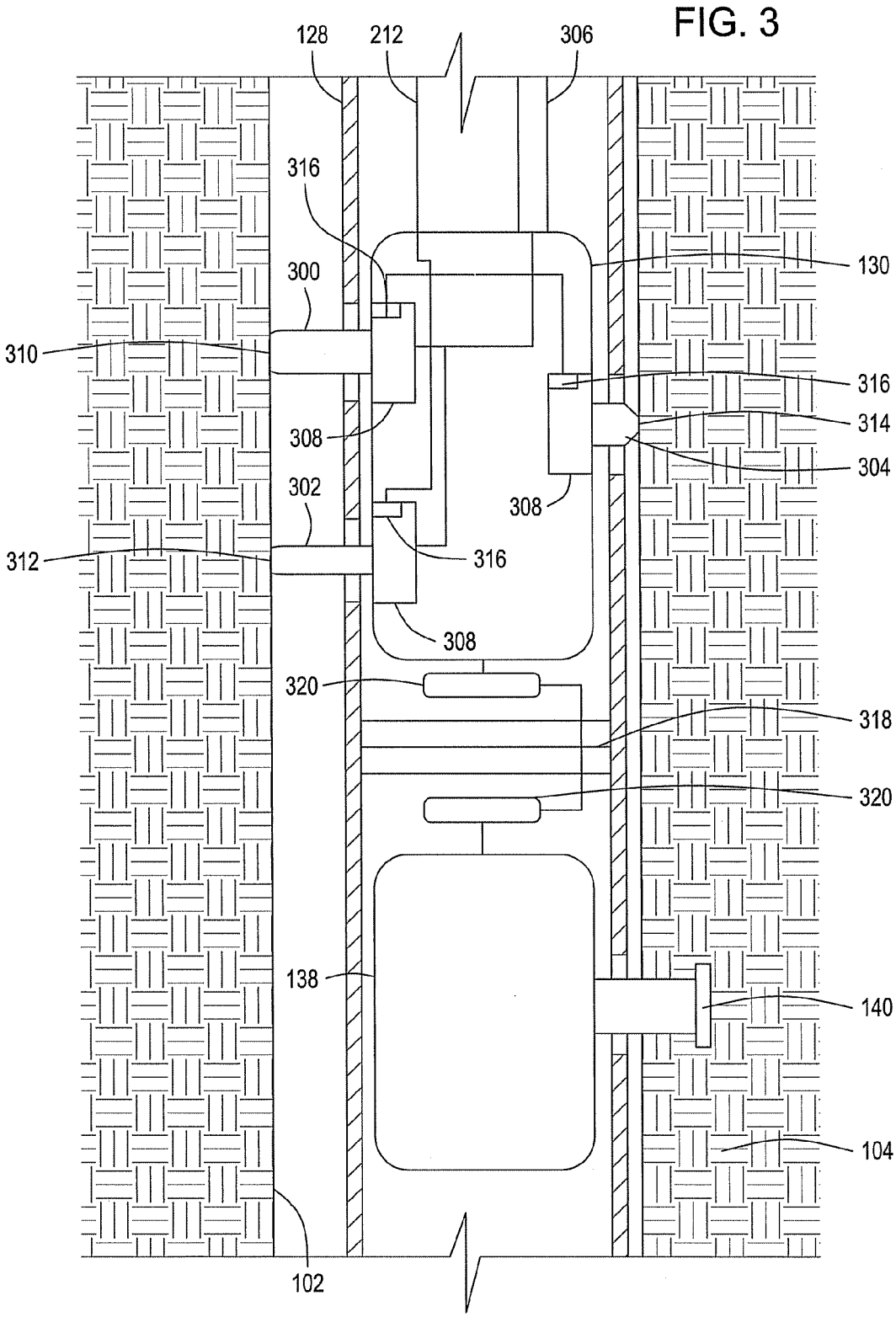
FIG. 3 represents a non-limiting example of a formation strength test device that may be used in several disclosed embodiments of a well logging apparatus.

Referring now to FIGS. 1 and 3, the formation strength test device 130 of the present disclosure may include one or more extendable pistons. In the example of FIG. 3, the formation strength test device includes extendable pistons 300, 302, 304 that may receive mechanical power from the mechanical power section 126 via a power transfer medium 306 coupled to the power generating device 136 and selected according to the particular power generating devices 136 used. For example, the power transfer medium 306 may be a hydraulic fluid conduit where the power generating device 136 includes a hydraulic pump, the power transfer medium 306 may be an electrical conductor where the power generating device 136 includes an electrical power generator, and the power transfer medium 306 may be a drive shaft or gearbox where the power generating device 136 includes a mechanical power output for extending the pistons 300, 302, 304. Each of the extendable pistons 300, 302, 304 may have a corresponding housing 308 that includes hydraulic, or mechanical assemblies used to extend the respective piston 300, 302, 304. The one or more extendable pistons 300, 302, 304 may be extended from the mandrel section 128 to engage the borehole wall with sufficient force to determine properties of the formation. In several examples the force may be selected to deform or break the formation at or adjacent the piston-formation interface.

Each of the pistons in the example shown includes a wall-engaging end 310, 312, 314 having a predetermined surface shape and area. The exemplary formation strength test device 130 includes one piston 300 having a wall-engaging end 310 optionally configured with a large surface area. Yet further optionally, the end 310 may be profiled having a radius of curvature about equal to the borehole 102 radius. A second of the extendable pistons 302 includes a wall-engaging end 312 with a surface area that is smaller than the end of the first piston 300, and the third of the extendable pistons 304 includes a wall-engaging end 314 with a surface area that is smaller than the second piston. The end of the third piston 304 may include a pointed or chisel-shaped end to increase the force per unit area. Information relating to the speed of extension, force applied by the respective piston, distance of piston travel and the like may be monitored by suitable sensors 316 associated with the respective piston. Information measured by the sensors 316 may be transmitted to the electronics section 124 via the data bus 212 for processing.

Continuing now with the exemplary tool of FIG. 3, a rotary side-wall coring tool 138 is shown coupled to the mandrel 128 below the formation strength test device 130. The relative positioning is not critical, and in some cases the tool string 106 may include two separate mandrels 128 with the formation strength test device 130 being disposed on one mandrel and the coring tool 138 being disposed on the second mandrel coupled to the first mandrel 128 using a suitable coupling 318. The coring tool 138 may be any coring tool having an extendable cutting hit 140 capable of cutting a core sample in the formation 104 adjacent the tool string 106. In several embodiments, one or more core samples may be dislodged and transported to the surface in the tool string 106 for surface testing. In several embodiments, one or more core samples may be left attached to the formation for in-situ testing as will be described later. Suitable coring tools for the purposes of this disclosure may be substantially as described in U.S. Pat. No. 5,617,927 for "Sidewall Rotary Coring Tool" and in U.S. Pat. No. 7,530,407 for "Rotary Coring Device and Method for Acquiring a Sidewall Core From an Earth Formation", both of which are assigned to the assignee of the present application.

Figure 4:
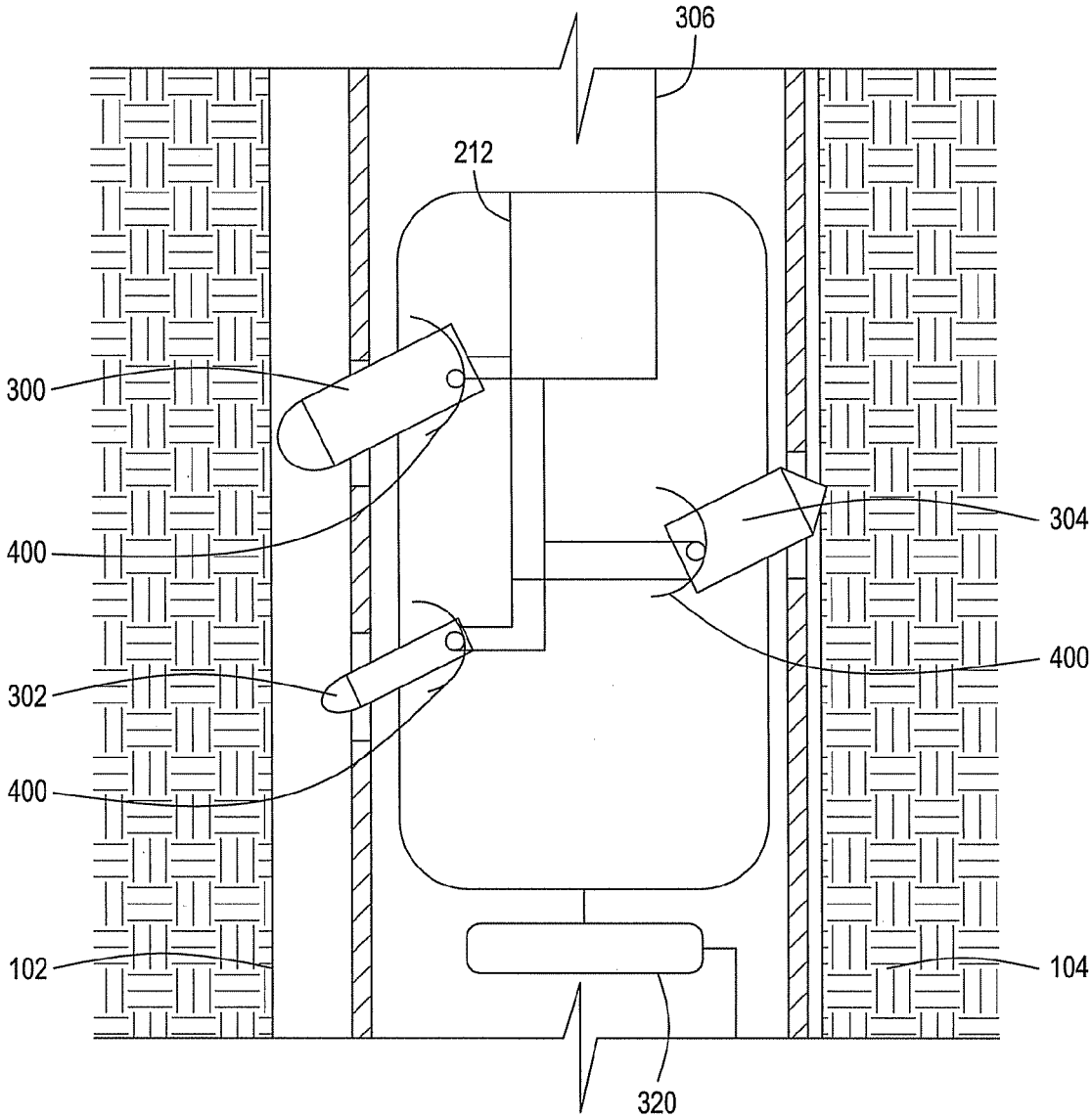
FIG. 4 illustrates an exemplary mandrel section that may be used in several disclosed embodiments of a well logging apparatus.

The formation strength test device 130 described above and shown in the exemplary views may include one or more articulated piston assemblies to move the respective pistons 300, 302, 304 in several angular directions with respect to the mandrel 128 longitudinal axis. Referring to FIG. 4, the mandrel 128 may include one or more extendable pistons 300, 302, 304 substantially as described above and shown in FIG. 3. Each piston 300, 302, 304 may be movably coupled to the mandrel 128 in a moveable relationship using a coupling 400 that allows articulated movement with at least one degree of freedom to engage the formation 104 at a desired angle of engagement. Each piston may be retracted and extended two or more times with the angle of engagement adjusted for each extension to obtain formation property information that is associated with each angle of engagement. This information may be used in estimating directional properties of the formation at the formation-borehole interface. The angle of engagement can be determined in part by the tool angular position with respect to vertical and/or the borehole. In several examples, tool angle and borehole angle may be substantially the same, and in other examples the tool may be angularly displaced within the borehole. In each case the tool angle may be determined using magnetometers, accelerometers and/or other suitable sensors 320 to determine the tool orientation and angle in real time. The angle of engagement can also be determined in part by the formation boundary angle with respect to vertical and/or the borehole or by a combination of the tool angle and the formation boundary angle. The formation boundary angle can be estimated from preexisting seismic information or by formation pressure tests designed to determine in real time the upper and lower formation boundaries at the borehole-formation intersection.

Continuing with FIG. 4, the coupling 400 may be, for example, a ball-joint coupling, a pivot pin coupling, a rail coupling, a rack and pinion coupling or the like. Each coupling may be controllably manipulated using commands generated from the surface by an operator or by the surface computer 116. In other embodiments the couplings may be controllably manipulated using commands generated by the downhole processing system 200 of FIG. 2. Shown schematically in FIG. 4 are rack and pinion type couplings with the pinion being rotatable by a suitable drive device that receives control signals via the power medium 306 described above and shown in FIG. 3. Likewise, the commanding information may be received at each coupling via the data bus 212 where the couplings are suited for receiving control signals. One example of such data bus control may include couplings having individual electrical stepper motors with on-board controllers. A position command may be sent to each motor independently such that the associated stepper motor may position the angle of the respective piston as desired. Individual positioning may alternatively be accomplished using individual hydraulic pumps and reservoirs or by using controllable valves to position each piston as desired. Whether the particular piston is configured for articulated angular motion or for unarticulated linear movement, the force applied to the formation location engaged by the piston and the piston wall-engaging surface characteristics may be known and/or measured to determine parameters at or near the coring location that are indicative of formation properties at or near the coring location.

Figure 5A:
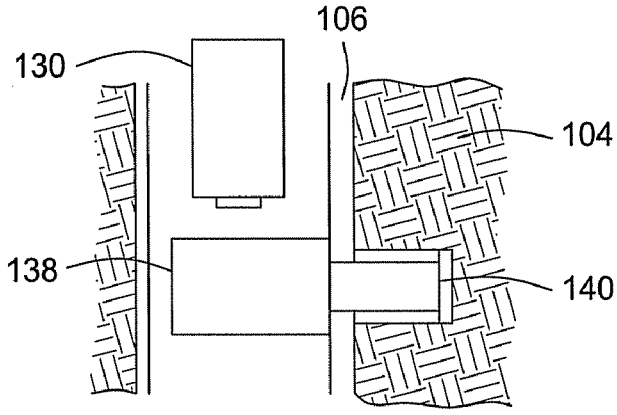
FIGS. 5A-5C illustrate formation strength testing performed on a core sample connected to a formation for a non-limiting free-standing method of testing the core sample.
Figure 5B:
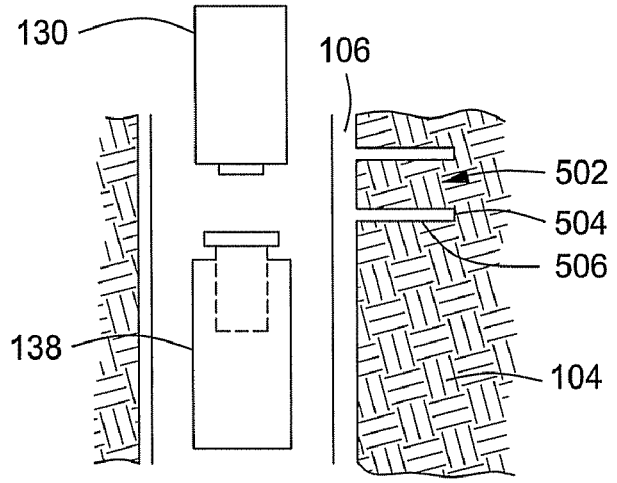
Figure 5C:
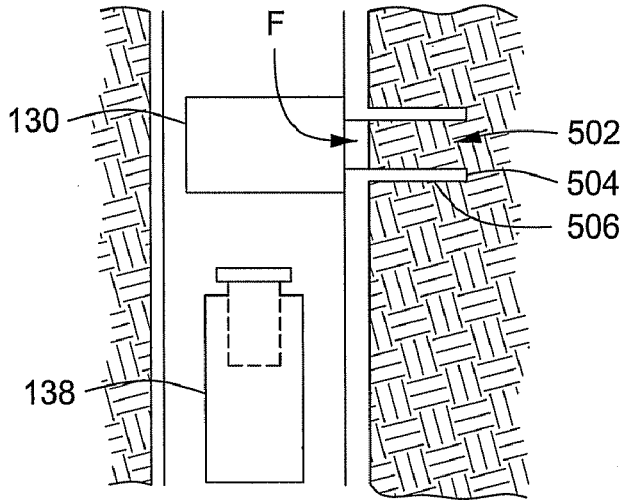

Referring now to FIGS. 5A-5C, formation strength testing may be performed on a core sample 502 connected to a formation 104 for a unique free-standing method of testing the core sample in-situ. FIG. 5A shows a coring tool 138 cutting a core sample in the formation 104. FIG. 5B shows the coring tool 138 in a retracted position within the tool string 106 with the core sample 502 remaining attached to the formation 104 at a base area 504 leaving an annular groove 506 around a cylindrical outer surface of the core sample 502. FIG. 5C then illustrates a formation strength test device 130 positioned substantially adjacent the cut core sample location and applying a force F to the core sample 502 in-situ. In the example of a free-standing test, the formation strength test device may have a single extendable piston 300 having a wall-engaging end that is about the same size as the inner diameter of the coring bit 140. Additional formation strength test pistons are not excluded from other examples of in-situ core sample tests, since pistons may be configured to engage the formation adjacent the cut core sample 502 yet vertically displaced and/or angularly displaced about the borehole wall. The piston 300 that engages the core sample 502 may be moved to the location of the core sample in several ways. In some examples, the mandrel 128 may be moved within the borehole 102 to bring the formation strength test device 130 to the core sample location. In other examples, the coring tool 138 and the formation strength test device 130 are each moveable within the mandrel 128 such that the mandrel may be anchored to the borehole wall using known anchoring devices. The following discussion and referenced figures illustrate examples of anchored mandrel tools.

Figure 6C:
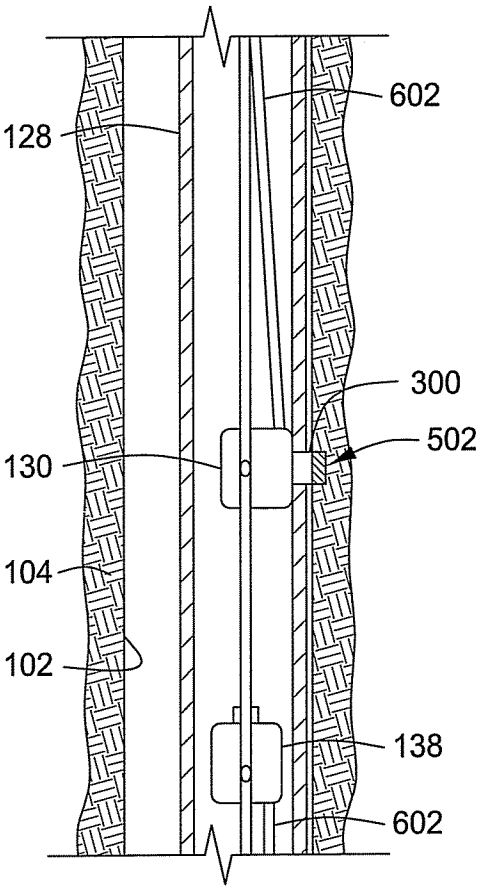
FIGS. 6A-6C illustrate an exemplary mandrel section having a formation strength test device and a sidewall rotary coring tool movably housed within a common mandrel section.
Figure 6B:
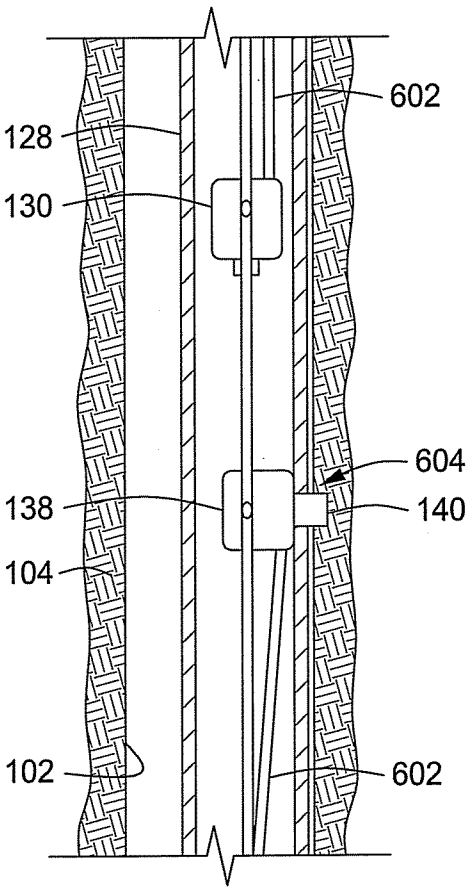
Figure 6A:
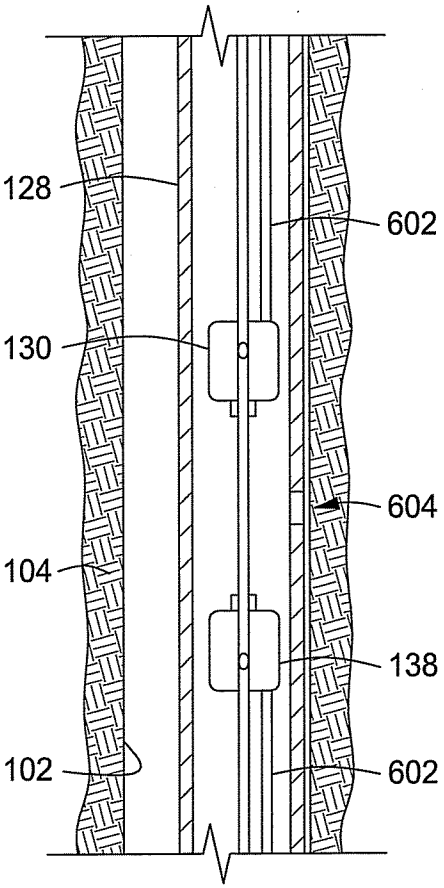

FIGS. 6A-6C illustrate an exemplary anchored mandrel 128 shown disposed within a well borehole 102 and anchored against a formation of interest 104. The anchoring mechanism, which is not shown in this view, may be any known mechanism for anchoring a downhole tool string 106 in place and is thus not shown or described in detail here. A formation strength test device 130 and a rotary sidewall coring tool 138 as described above are housed within the mandrel 128 and coupled to an engaging mechanism 602 that may be controlled using, for example, the information processing system 200 in the electronics section 124 to move the formation strength test device 130 and the coring tool 138 to a common port 604 in the side of the mandrel 128 for accessing the adjacent formation 104. Examples of suitable engaging systems 602 for a coring tool 138 are disclosed in U.S. Pat. No. 5,617,927 for "Sidewall Rotary Coring Tool" and in published U.S. Pat. No. 7,530,407 for "Rotary Coring Device and Method for Acquiring a Sidewall Core From an Earth Formation", both of which are assigned to the assignee of the present application, and which publications are incorporated herein by reference. With the benefit of the present disclosure, a multi-tool engaging mechanism 602 may be constructed to bring each tool 130, 138 in contact with the formation 104 at a common location. FIG. 6A shows the formation strength test device 130 and the coring tool 138 each in a retracted position that may be used when the mandrel 128 is being moved through the well borehole 102. While the scope of the disclosure includes formation strength testing prior to cutting a core sample, the example here illustrates a free-standing test where a core sample is cut prior to formation strength testing.

FIG. 6B shows the coring tool 138 moved to an engaging position using the engaging mechanism 602. The core bit 140 is extended and rotated to cut a core sample 502, and in FIG. 6C the coring tool 138 is retracted and the formation strength test device 130 is moved to the port 604 to engage the cut core sample 502 using the formation strength test device 130 extendable piston 300. A sensor assembly that will be described in detail later with reference to FIGS. 7 through 8B may be used in conjunction with other sensors to determine radial deformation characteristics of the core sample 502.

Referring to FIGS. 5A-C and FIG. 7, the exemplary formation strength test device 130 is shown in engagement with a cut core sample 502. The core sample 502 base 504 is connected to the formation 104 with the cylindrical annular region 506 formed about the core sample 502 by the coring tool bit 140. The extendable piston 300 has a wall-engaging end that is selected to engage a free end of the core sample. In several embodiments, the wall-engaging end of the piston has a contact area substantially equal to the core sample free end. This may be accomplished by selecting a piston having a wall-engaging end that includes a diameter substantially equal to the coring bit 140 inner diameter and a surface area having a radius of curvature about equal to the borehole 102 radius. The formation tool includes sensors 702, 704 as discussed above for measuring piston movement and applied force. The formation strength test device 130 in this example further includes a sensor assembly 706 that senses core sample radial deformation within the annular region 504 about the core sample 502. The sensor assembly 706 may include any of several sensor transducers 708. Some non-limiting examples include acoustic sensors, optical sensors, displacement sensors, strain sensors, deflection sensors and pressure sensors. In some examples, the sensor assembly 702 includes an extendable member 710 that extends from the formation strength test device 130 and into the annular region 504 to directly measure core sample deformation in a direction radial to the core sample axis. In the case of acoustic and optical sensors, non-invasive sensing without the use of the extendable member 710 may be used to estimate core sample deformation.

Figure 7:
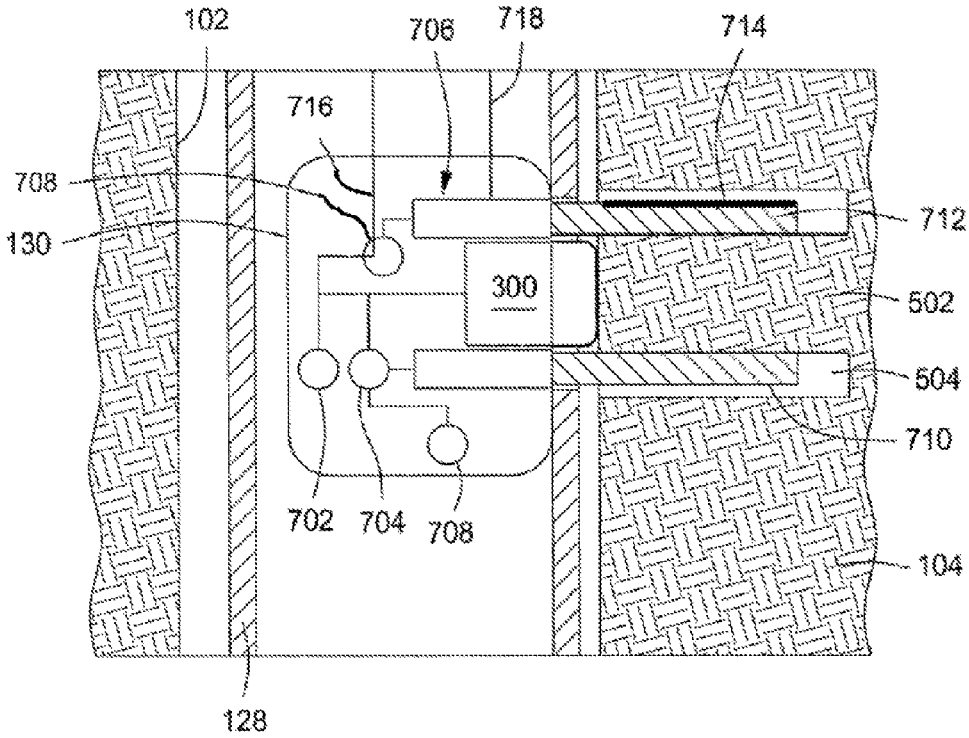
FIG. 7 illustrates a non-limiting formation strength test device that includes a sensor assembly for estimating radial deformation of an in-situ core sample.

The example of FIG. 7 shows a cylindrical extendable member 710 that includes a rigid or semi-rigid internal support 712 that is extended into the annular region 504 around the core sample 502. An expandable bladder 714 is mounted on the sensor assembly 710 to extend with the internal support 712 into the annular region 504. The expandable bladder 714 may be expandable using a hydraulic fluid or drilling mud. One or more pressure sensors 708 associated with the formation strength test device 130 measure the pressure within the expandable bladder 714. Radial deformation of the core sample 502 due to force exerted by the piston 300 will cause a pressure change within the bladder 714, and the pressure sensor 708 may be used to determine the amount of pressure change within the bladder 714. The sensed pressure change may then be transmitted to a processor for estimating the radial deformation in the core sample. The sensor assembly 706 may be controlled from the surface using a processing system 116 as described above and shown in FIG. 1 or by using a downhole information processing system 200 housed, for example, in the electronics section 124 of the tool string 106. Separate piston control lines 716, 718 may be used, respectively, to control force applied by the piston 300 and to control extension of the extendable sensor assembly 702. The pressure change, coupled with measurements or knowledge of the bladder volume within the annular region, the volume of the annular region, the core sample dimensions and the unit force per area applied by the piston 300 to the core sample may be used individually or together to estimate formation strength at the core sample location.

Figure 8A:
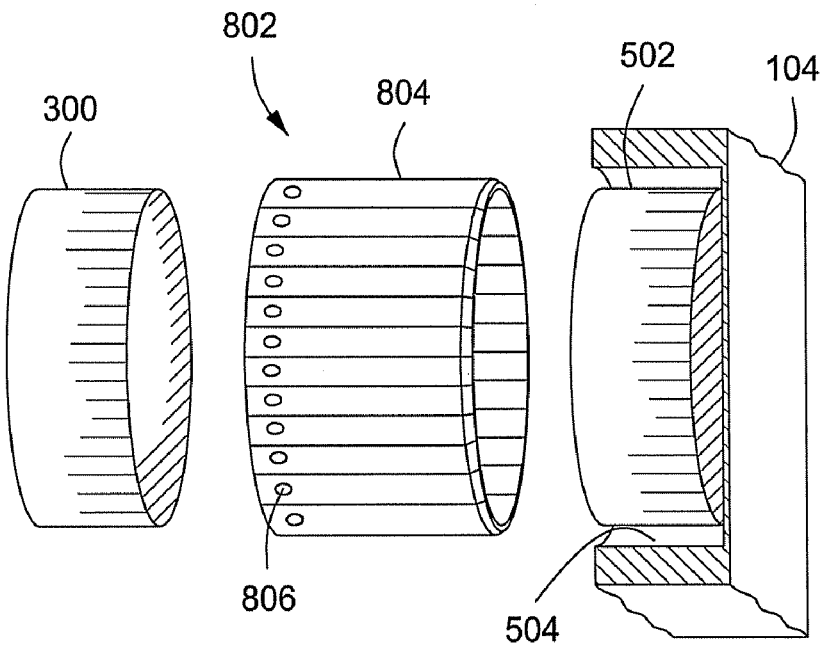
FIGS. 8A and 8B show an exemplary sensor assembly for estimating radial deformation of an in-situ core sample.
Figure 8B:
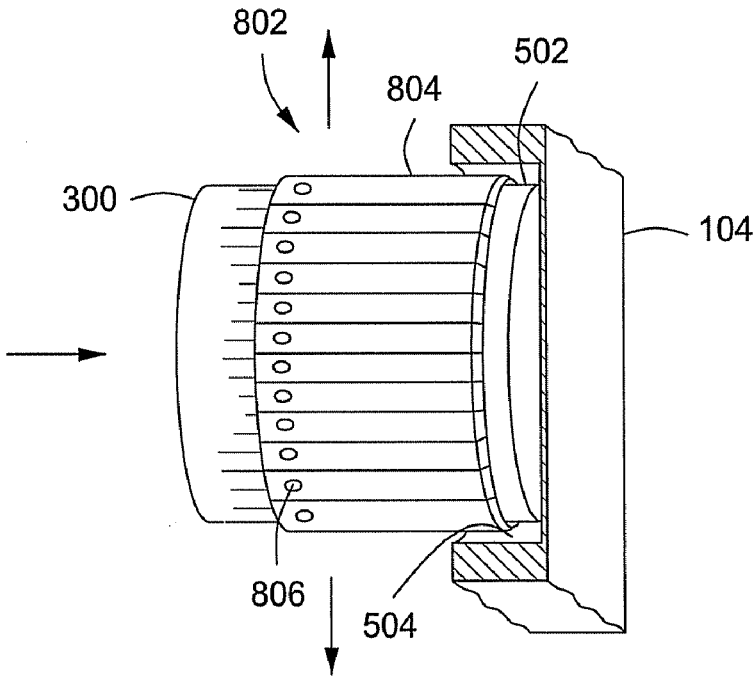

FIGS. 8A-8B illustrate another example of a sensor assembly 802 for use in one or more embodiments disclosed. FIG. 8A shows a partially exploded view of an extendable piston 300, and the extendable sensor assembly 802 is movably disposed about the piston 300. The extendable sensor assembly 802 and piston 300 are shown adjacent a cut core sample 502 that is connected to a formation of interest 104 and having an annular region 504 formed by a rotary coring tool 138 as described above.

In the example of FIGS. 8A-8B, a ring of substantially rigid members 804 comprise a portion of the extendable sensor assembly 802. The rigid members 804 may be constructed of stainless steel or other material that provides durability in the downhole environment. One or more of the rigid members 804 has coupled thereto an associated strain gauge 806, and the extendable sensor assembly 802 is slidingly disposed about the piston 300. In this manner, as shown in FIG. 8B, the sensor assembly 802 may be extended into the annular region 504 and the piston 300 may be extended to engage the free end of the cut core sample 502. Force applied to the free end of the core sample 502 by the piston 300 will eventually cause deformation of the core sample 502. The deformation will include deformation in a direction coaxial with the piston and core sample as well as deformation radial to the core sample axis and into the annular region 504. Force and displacement sensors 702, 704 may be coupled to the piston 300 as described above and shown in FIG. 7 and used to determine force applied by the piston 300 to the core sample 502 and to determine axial deformation of the core sample 502. The extendable sensor assembly 802 will be deflected outwardly in a radial direction when there is radial deformation of the core sample 502. The strain gauges 806 coupled to the several rigid members 804 will detect the radial deformation and convert the movement into electrical signals that may then be used to determine characteristics of the radial deformation. The particular number of rigid members 804 and the number of strain gauges 806 used may vary depending on several factors of construction. For example, the diameter of the core sample may be a factor in deciding on the particular number of rigid members and/or the number of strain gauges used.

Figure 9:
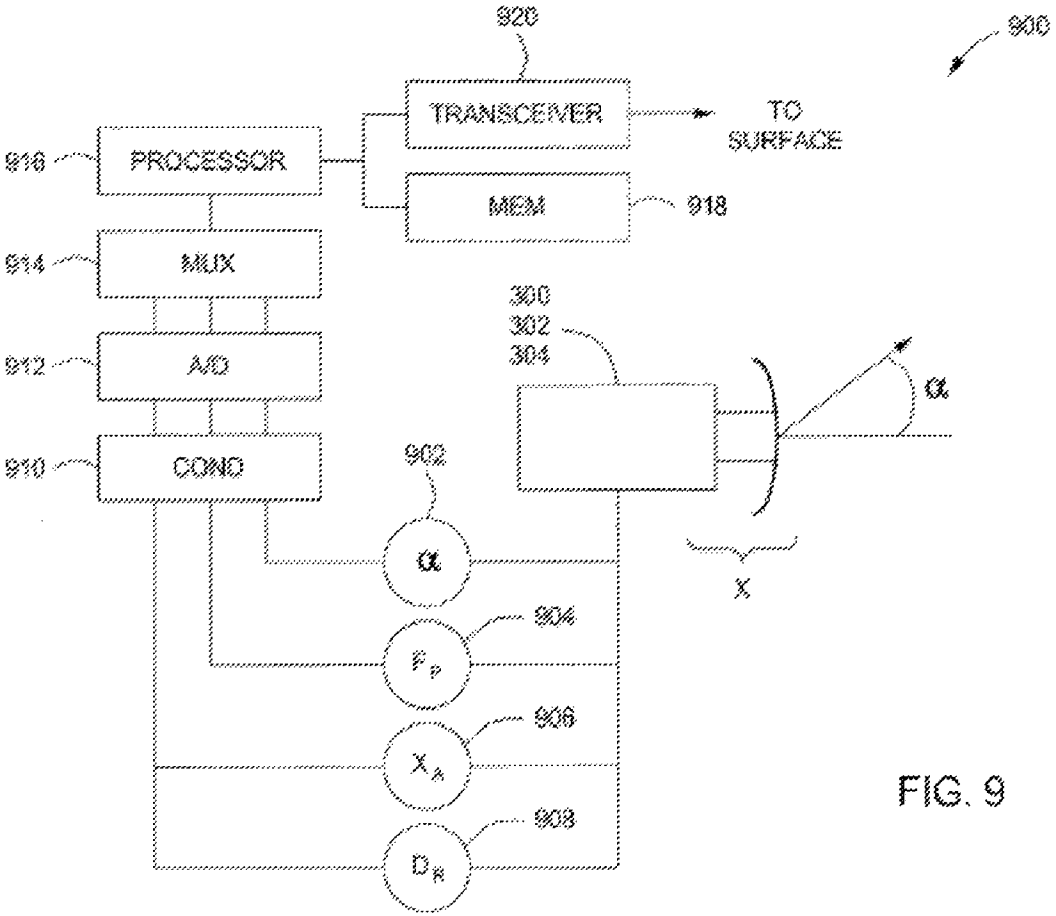
FIG. 9 is a non-limiting schematic illustration of a measurement and control circuit that may be used according to several embodiments of the present disclosure.

FIG. 9 is a schematic illustration of a measurement and control circuit 900 that may be used according to the present disclosure. The measurement and control circuit includes one or more angular position sensors 902, force sensors 904, displacement sensors 906 and radial deformation sensors 908 to estimate parameters such as angle $\alpha$, piston force $F_P$, and piston extension X for each of the extendable pistons 300, 302, 304. The radial deformation sensors 908 are used in free-standing in-situ tests as discussed above to estimate core sample radial deformation $D_R$. The sensors 902, 904, 906 and 908 may be coupled to transmit sensor output signals to respective signal conditioning circuits 910 for filtering the signals as needed. The signal conditioning circuits 910 may be coupled to transmit conditioned signals to an analog-to-digital converter (ADC) circuit 912 where any of the sensors does not provide a digital output signal. ADC circuit 912 output signals may be fed into a multiplexer circuit 914 or into a multi-channel input of a processor 916. The processor 916 may then feed processed signals to a memory 918 and/or to a transceiver circuit 920. The processor 916 may be located on the tool string 106 as noted above or may be a surface processor such as the processor 116 described above and shown in FIG. 1. When using a downhole processor, commands may be received via the transceiver circuit 920. Downhole command and control of the tool string 106 and of the pistons may be accomplished using programmed instructions stored in the memory 918 or other computer-readable media that are then accessed by the processor 916 and used to conduct the several methods and downhole operations disclosed herein. The information obtained from the sensors may be processed down-hole using the electronics section 124 with the processed information being stored downhole in the memory 918 for later retrieval. In other embodiments, the processed information may be transmitted to the surface in real time in whole or in part using the transceiver 920.

Downhole tools such as those described above and shown in FIGS. 1-9 or similar tools may be used to carry out methods that will now be described in detail. In the several non-limiting method examples to follow, one or more formation properties may be estimated using in-situ formation strength measurements substantially adjacent a core sample location. A core sample location is a location within a well borehole where a coring tool engages the subterranean formation to cut a formation core sample from the subterranean sample. Extracting a core sample from a borehole wall area is becoming increasingly popular due to tools such as rotary sidewall coring devices. Sidewall formation properties estimated from measurements made at or near the core sample location provide valuable information obtained using actual in-situ conditions.

Formation properties include several components that may be measured in-situ or estimated using in-situ measurements provided by the formation strength test tool of the present disclosure. The several components of formation properties include stress, Young's modulus, Poisson's Ratio and formation unconfined compressive strength. A short discussion of these formation properties follows.

Stress on a given sample is defined as the force acting on a surface of unit area. It is the force divided by the area as the area approaches zero. Stress has the units of force divided by area, such as pounds per square inch, or psi, kilo Pascals (kilo Newtons per square meter), kPa, MPa, etc. A given amount of force acting on a smaller area results in a higher stress, and vice versa.

The Young's modulus of a rock sample is the stiffness of the formation, defined as the amount of axial load (or stress) sufficient to make the rock sample undergo a unit amount of deformation (or strain) in the direction of load application, when deformed within its elastic limit. The higher the Young's modulus, the harder it is to deform it. It is an elastic property of the material and is usually denoted by the English alphabet E having units the same as that of stress.

The Poisson's ratio of an elastic material is also its material property that describes the amount of radial expansion when subject to an axial compressive stress (or deformation measured in a direction perpendicular to the direction of loading). Poisson's ratio is the ratio of the elastic material radial deformation (strain) to its axial deformation (strain), when deformed within its elastic limit. Rocks usually have a Poisson's ratio ranging from 0.1 to 0.4. The maximum value of Poisson's ratio is 0.5 corresponding to an incompressible material (such as water). It is denoted by the Greek letter $\nu$ (nu). Since it is a ratio, it is unitless.

The Unconfined Compressive Strength (UCS) of a material is the maximum compressive stress an element of rock can take before undergoing failure. It is usually determined in the laboratory on cylindrical cores, subjected to axial compressive stress under unconfined conditions (no lateral support or confining pressure being applied on the sides). It has the same units as that of stress (force per unit area: psi, MPa, etc.).

In-situ stresses are the stresses that exist within the surface of the earth. There are three principal (major) stresses acting on any element within the surface of the earth. The three stresses are mutually perpendicular to one another and include the vertical (overburden) stress resulting from the weight of the overlying sediments ($\sigma_v$), the minimum horizontal stress ($\sigma_{Hmin}$) resulting from Poisson's effect, and maximum horizontal stress ($\sigma_{Hmax}$) resulting from Poisson's and tectonic/thermal effects.

FIGS. 10 and 11 illustrate a core sample test used to determine Young's modulus (E), Poisson's ratio ($\nu$) and the unconfined compressive strength (UCS) for a free-standing cylindrical rock sample. FIG. 10 illustrates a free-standing core sample test. A force (F) is applied to a cylindrical sample having a free end surface of diameter (D) and a core sample length (L). The core sample is fixed at a base location and is free to deform in an axial direction and in a radial direction due to the force (F) applied to yield $\sigma_1$=F/area, where $\sigma_1$ is the maximum applied axial stress on the sample. Deformation in the axial direction is noted in the figure as $\delta_1$ and deformation in the radial direction is noted by $\delta_3$. Using these parameters yields E, $\nu$ and UCS as follows in equations 1, 2 and 3 below.

$$E=\delta\sigma_1/\delta\epsilon_1 \quad \text{Equation 1}$$

$$\nu=-\delta\epsilon_3/\delta\epsilon_1 \quad \text{Equation 2}$$

$$UCS=\sigma_{max} \quad \text{Equation 3}$$

In these equations, $\epsilon_1=\delta_1/L$ and $\epsilon_3=2*\delta_3/D$. One may use known, calculated or measured values for the force applied, the cross-section area of the sample, the length of the unstressed sample cylinder, the vertical deformation and the radial deformation to provide estimates of E, $\nu$ and UCS.

These parameters provide valuable information for determining the viability of a subterranean formation for hydrocarbon production.

FIG. 11 illustrates a stress vs. strain plot of the test graphically illustrated in FIG. 10. Here, the vertical axis is stress $\sigma_1$ and the horizontal axis is the axial compression $\epsilon_1$ and radial expansion $\epsilon_3$ of the core sample under the load F.

Figure 12:
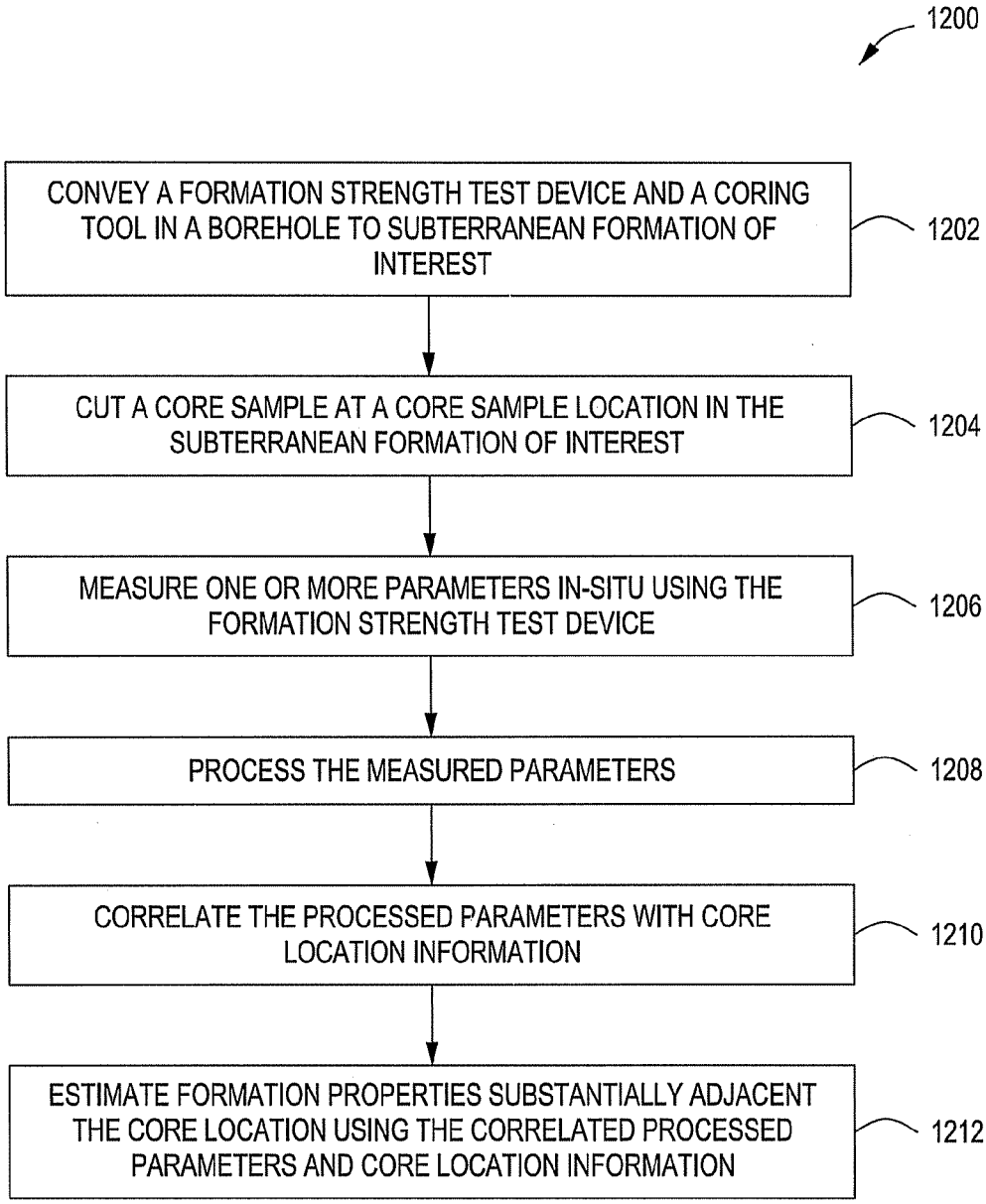
FIG. 12 is a non-limiting method for estimating formation strength at or near a core location.

FIG. 12 is a flow diagram to illustrate a non-limiting method for estimating one or more formation properties by obtaining in-situ measurements substantially adjacent a core sample location. The method 1200 includes conveying a coring tool and a formation strength test tool into a well borehole to a formation of interest 1202. A core sample is cut according to this example in the formation 1204. One or more parameter measurements such as strength measurements are made in-situ substantially adjacent core sample location 1206. Information from the in-situ parameter measurements are processed 1208 using a processor and correlated with core location information 1210. Core location information may include any information that relates to the location at which the core sample is taken. For example, the core location information may include depth, temperature, formation pressure and any other information that may be correlated with the formation parameters to obtain an estimate of the formation of interest structure, strength and production value. The correlated processed parameter information and core location information are used in several examples to estimate one or more formation properties substantially adjacent the core sample location 1212. The estimate may then be used in determining the viability of the subterranean formation of interest for hydrocarbon production and/or structural purposes.

In one embodiment, a formation strength test device is used to obtain formation property information 1206 prior to cutting a core sample 1204. In another example, a core sample is cut 1204 using a core tool prior to conducting a formation strength test device 1206. In yet another example, the formation strength test and core sample are conducted simultaneously.

The location of the formation strength test and the location of the core sampling are each at the formation of interest and substantially adjacent the same location. As used herein, "substantially adjacent" is used to mean respective borehole wall areas for the formation strength test and core sample that may be overlapping in whole or in part, may be adjacent borehole wall areas, may include areas displaced about the circumference of the borehole wall at the formation of interest, and may include areas that are displaced axially along the borehole wall. Measurements substantially adjacent a core sample location include measurements within a tool, measurements made in or on the borehole wall, and measurements that are affected by any interaction with the formation substantially adjacent a formation sampling location.

In one embodiment, a carrier that carries the formation strength test tool and the coring tool may be adjusted or moved within the borehole to bring the formation strength test tool and the coring tool to engage the borehole wall at the selected location. In another embodiment, a carrier that carries the formation strength test tool and the coring tool may be fixed within the borehole using one or more packers, an extendable anchor or other device that will hold the carrier at a fixed location. In the example of a fixed carrier, the formation strength test tool and the coring tool may be disposed on the carrier in fixed locations to engage the borehole wall in adjacent or slightly displaced locations on the borehole wall. In other examples, the carrier may be fixed at a location with the formation strength test tool and the coring tool being disposed on the carrier in a moveable manner to allow the formation strength test tool and the coring tool to engage the borehole wall in a common location on the borehole wall.

In one example method includes moving a coring tool to a selected borehole wall location and cutting a core in the formation of interest without dislodging the core sample from the formation. This is accomplished by using a core tool to cut into the formation and then extracting the core bit from the formation while leaving the core sample connected to the formation. With the core sample still connected to the formation, a formation strength test tool engages the core sample. A force is applied to the core sample using the formation strength test tool. Measurements are made to determine the force applied and the piston extension distance. Core sample deformation is also measured, and the in-situ measurements are used to estimate one or more formation properties substantially adjacent the core sample location. In several examples, the core sample deforms in a radial direction in an annular space around the core sample formed by the coring tool bit. This radial deformation may be measured by various sensor types as described above. Some non-limiting examples of sensor types that may be used to measure the radial deformation of the core sample include, but are not limited to, displacement sensors, pressure sensors, strain gauges, optical sensors and acoustic sensors.

The present disclosure is to be taken as illustrative rather than as limiting the scope or nature of the claims below. Numerous modifications and variations will become apparent to those skilled in the art after studying the disclosure, including use of equivalent functional and/or structural substitutes for elements described herein, use of equivalent functional couplings for couplings described herein, and/or use of equivalent functional actions for actions described herein. Such insubstantial variations are to be considered within the scope of the claims below.

What is claimed is:

1. An apparatus for estimating a formation property comprising:

a mandrel;

a coring tool in the mandrel and adapted to cut a core sample in a formation;

a member in the mandrel and having a distal end that engages a borehole wall substantially adjacent the core sample;

a drive device in the mandrel that engages the member to the borehole wall with a force sufficient to estimate borehole strength;

an articulated coupling that couples the member to the mandrel; and a positioning device orienting the member at an angle oblique to a longitudinal axis of the mandrel so that force is applied to the borehole wall at an oblique angle of engagement.

2. An apparatus according to claim 1, wherein the coring tool is conveyable on a wireline, a while drilling sub, or both.

3. An apparatus according to claim 1 further comprising a rotatable section that is rotatable with respect to a longitudinal axis of a carrier, the member being coupled to the rotatable section.

4. An apparatus according to claim 1 further comprising a sensor in communication with the member for sensing the force applied by the member to the formation.

5. An apparatus according to claim 1, wherein each of the coring tool and the member is movably disposed within the mandrel.

6. An apparatus according to claim 5 further comprising one or more engaging mechanisms coupled to the coring tool and the member to move each of the coring tool and the member to a common port for accessing a common borehole wall location.

7. An apparatus according to claim 1 further comprising a measurement device that includes one or more of an acoustic sensor, an optical sensor, a displacement sensor, a strain sensor, a deflection sensor, and a pressure sensor.

8. An apparatus according to claim 1 further comprising a measurement device that engages a core sample perimeter portion, the core sample being attached to the formation of interest.

9. An apparatus according to claim 1 further comprising a measurement device having an expandable bladder that engages a core sample perimeter portion, the core sample being attached to the formation of interest.

10. An apparatus according to claim 1 further comprising a measurement device having one or more substantially rigid members that extend into an annular region around a core sample that is attached to the formation of interest.

11. An apparatus according to claim 1 further comprising an information processor for processing information obtained by a measurement device.

12. An apparatus according to claim 1, wherein the member comprises a plurality of extendable pistons that selectively engage the borehole wall.

13. A method for estimating a formation property comprising:

cutting a core sample in a formation using a coring tool;

engaging a borehole wall substantially adjacent the core sample location with a member using a drive device that engages the member to the borehole wall with a force sufficient to estimate formation strength; and wherein the member engages the borehole wall at an oblique angle of engagement.

14. A method for estimating a formation property comprising:

providing a formation property testing device comprising a mandrel, a coring tool in the mandrel, and formation testing members in the mandrel;

using the coring tool to cut a core sample in a subterranean formation, the cut core sample remaining connected to the subterranean formation;

extending the formation testing members from the mandrel to perform a formation strength test on the cut core sample in-situ; and performing at least one formation strength test substantially adjacent the cut core sample, wherein the formation strength test is performed by orienting at least one of the formation strength testing members at an angle oblique to a longitudinal axis of the mandrel so that force is applied to the borehole wall at an oblique angle of engagement.

15. A method according to claim 14, wherein a plurality of formation strength tests are performed substantially adjacent the cut core sample.

16. A method according to claim 14, further comprising estimating a formation property at least in part using the formation strength test.

17. A method according to claim 14, wherein the formation testing member tests the formation before the coring tool is used to cut the core sample.

18. A method according to claim 14 further comprising processing information relating to the formation strength using an information processor.

19. A method according to claim 18, wherein the information processor is located downhole.

20. A method for estimating a formation property comprising:

providing a formation property testing device comprising a mandrel, a coring tool in the mandrel, and formation testing members in the mandrel;

deploying the formation property testing device in a wellbore;

using the coring tool to cut a core sample in a subterranean formation adjacent the wellbore;

extending one of the formation testing members from the mandrel and oblique to an axis of the wellbore to perform a formation strength test on the cut core sample in-situ at an oblique angle of engagement; and obtaining formation property information associated with an angle of engagement between the extended formation testing member and the formation.

* * * * *